US007639828B2

(12) United States Patent
Platz

(10) Patent No.: US 7,639,828 B2
(45) Date of Patent: Dec. 29, 2009

(54) WIRELESS HEARING SYSTEM AND METHOD FOR MONITORING THE SAME

(75) Inventor: Rainer Platz, Colombier (CH)

(73) Assignee: Phonak AG, Staefa (CH)

( * ) Notice: Subject to any disclaimer, the term of this patent is extended or adjusted under 35 U.S.C. 154(b) by 811 days.

(21) Appl. No.: 11/316,363

(22) Filed: Dec. 23, 2005

(65) Prior Publication Data

US 2007/0147641 A1 Jun. 28, 2007

(51) Int. Cl.
*H04R 25/00* (2006.01)

(52) U.S. Cl. ..... 381/315; 381/312; 381/331

(58) Field of Classification Search ..... 381/315
See application file for complete search history.

(56) References Cited

U.S. PATENT DOCUMENTS 5,721,783 A 2/1998 Anderson
2003/0045283 A1* 3/2003 Hagedoorn ..... 455/426
2005/0100182 A1* 5/2005 Sykes et al. ..... 381/315

FOREIGN PATENT DOCUMENTS

EP 0 681 411 B1 11/1995
WO WO 02/23948 A1 3/2002

* cited by examiner

*Primary Examiner*—Brian Ensey
*Assistant Examiner*—Matthew Eason
(74) *Attorney, Agent, or Firm*—David S. Safran; Roberts Mlotkowski Safran & Cole, P.C.

(57) ABSTRACT

A hearing system is provided, having a hearing device, an audio signal transmitter, an audio signal source for providing audio signals to the audio signal transmitter, an audio signal receiver unit adapted to establish a wireless link for transmission of the audio signals from the audio signal transmitter to the audio signal receiver unit which is connected to or integrated within the hearing device, a device for generating and wirelessly transmitting a polling signal to the audio signal receiver unit, a device for receiving the polling signal at the audio signal receiver unit, a device for generating and wirelessly transmitting a status information signal containing data regarding the status of the wireless audio signal link or the receiver unit, and a device for receiving the status information signal and displaying status information.

30 Claims, 3 Drawing Sheets

WIRELESS HEARING SYSTEM AND METHOD FOR MONITORING THE SAME

BACKGROUND OF THE INVENTION

1. Field of the Invention

The present invention relates to a hearing system comprising a hearing device to which an external audio signal is provided via a wireless, typically a radio frequency (RF) link. The invention also relates to a system for providing audio signals to a hearing device via a wireless link and to a method for monitoring a hearing system comprising a hearing device to which audio signals are provided via a wireless link.

2. Description of Related Art

It is well known to provide an external audio signal to a hearing aid via a radio frequency (RF) link, usually a frequency modulated (FM) link. The RF receiver can be integrated within the hearing aid or it can be an external component which is connected to the hearing aid via a suited and often standardized mechanical and electrical interface. A common application of such systems is the education of students in a classroom by a teacher. In this case the external audio signal is the teacher's voice which is picked-up by a microphone and is sent to the hearing aid of each student via the RF link. Another application of such a wireless system is the case in which parents want to communicate with their child wearing a hearing aid via a wireless microphone and a RF link to the hearing aid.

Conventionally, single channel FM receivers were used for establishing the RF link between the remote audio signal source and the hearing aid. Such systems are available with a "no FM" indicator LED indicating the absence of a carrier on the receiving channel. Such conventional devices are strictly unidirectional, with no signal being sent back from the RF receiver.

More recent devices are designed as multi-channel receivers capable of changing between several audio signal transmission channels, i.e. frequency bands. With such devices, for example, each teacher may use his own transmission channel. Further, the students may be addressed individually via associated transmission channels. The selection of the receiving channel of the RF receiver may be controlled automatically, for example, by a wireless control panel installed at the wall of each classroom.

Further, it is known to use an RF link for remote programming of a hearing aid, respectively an FM receiver. An example of a multichannel RF system for a hearing aid is described in WO 02/23948 A1, wherein the RF receiver connected to the hearing aid also is adapted for remote programming via an FSK (frequency shift keying) modulation used for data transmission between the remote programming unit and the RF receiver. Such FSK link is bidirectional, wherein the RF receiver may transmit information regarding the version of the software installed in the hearing aid to the remote programming unit. It is also mentioned in WO 02/23948 A1 that the bidirectional link for remote programming also could be an inductive link rather than a RF link.

In products which are presently on the market the bidirectional remote programming wireless link may be used for reading identifying information such as serial number, school and student's name from the RF receiver.

An example for a wireless remote control for a hearing aid is given in EP 0681411 B1, wherein the hearing aid has a transmitter/receiver unit for establishing wireless communication with the transmitter/receiver unit of a remote control, wherein audiometric data, hearing parameters, algorithms, fuzzy input and configuration information can be transmitted from the hearing aid to the remote control.

U.S. Pat. No. 5,721,783 describes a "distributed" hearing system, comprising an earpiece including a speaker and a microphone and a body-worn remote processor unit between which a bidirectional RF link is established for transmitting audio signals generated in the earpiece by the microphone to the remote processor unit for signal processing, with the processed audio signals being sent back from the remote processing unit to the earpiece for providing an acoustic signal via the speaker in the earpiece to the user. Thus, the RF link is used for bidirectional transmission of audio signals. A secondary wireless link may be provided to the remote processor unit for supplying external audio signals, such as from a telephone, to the speaker of the earpiece.

There are many applications of a hearing device provided with external audio signals via a wireless link in which it would be desirable to know whether the user of the hearing device properly receives the transmitted external audio signal. This applies particularly to the case in which the user of the hearing device is a child. The reason is that usually adults will easily remark and complain about non-working radio systems, while this cannot be expected in all cases from children, even more so in classroom applications.

Consequently it is an object of the invention to provide for a hearing system comprising a hearing device provided with an external audio signal via a wireless link, which allows a person, such as teachers or parents to monitor the reception of the external audio signal by the user of the hearing device. It is a further object of the invention to provide for a corresponding system for providing audio signals to a hearing device via a wireless link. It is a still further object of the invention to provide for a method for monitoring a hearing system comprising a hearing device provided with external audio signals via a wireless link.

SUMMARY OF THE INVENTION

According to the invention, these objects are achieved by a hearing system, a system for providing audio signals to a hearing device and a method for monitoring a hearing system as described below.

The invention is beneficial in that, by polling the audio signal receiver unit in order to transmit a status information signal containing data regarding the status of the wireless audio link and/or the audio signal receiver unit and by displaying such status information, the wireless audio signal link can be monitored in a very easy manner by persons other than the user of the hearing device. This is particularly beneficial if the user of the hearing device is a child and the parents or a teacher of the child wishes to know whether at all and/or in which quality the external audio signal, for example, the parent's or teacher's voice, can be received by the child.

In general, the hearing device could be any type of wireless headset, such as a part of a tourist tour guide or museum guide system. However, preferably the hearing device is a hearing aid. Preferably, the status information signal in this case includes information regarding at least one of the following: integrity of the electrical connections between the audio signal receiver and the hearing aid, present frequency (channel) or frequency band of the wireless link carrying the audio signal, confirmation of remote control commands for setting the operation mode/operation parameters of the audio signal receiver unit, present operation mode of the audio signal receiver unit, present setting of operation parameters of the audio signal receiver unit, signal to noise ratio of the wireless link carrying the audio signal, battery status of the audio signal receiver unit or of the hearing aid, identification of the audio signal receiver unit among a plurality of audio signal receiver units, date of last servicing of the audio signal receiver unit, and user's name. The status information signal also may include information regarding the present operation mode of the hearing aid and/or present setting of operation parameters of the hearing aid, which information is provided via an interface from the hearing aid to the audio signal receiver unit.

Usually the wireless link carrying the audio signal will be a radio frequency link, preferably an FM (frequency modulation) link.

Preferably, the audio signal source is a remote microphone, which is used, for example, by a teacher in the classroom.

The status information signal may include data on whether the audio signal receiver unit is for a right ear or a left ear. In this case, the left ear/right ear differentiation of the status information may be done by time-delaying the response of the right and the left audio signal receiver unit.

According to a preferred embodiment, the audio signal source and/or the audio signal transmitter and/or the means for generating and transmitting the polling signal and/or the means for receiving the status information signal and displaying status information are integrated in a common device which is a portable, preferably hand-held, device.

Preferably, the means for receiving the status information signal and displaying status information is adapted to display the status information graphically. The means for receiving the status information signal and displaying status information may be adapted to display the status information together with data identifying the audio signal receiver unit among a plurality of audio signal receiver units, whereby the displayed status information can be easily attributed to a certain person.

The means for generating and transmitting the polling signal may comprise an activation element which is manually operable and/or an activation timer in order to periodically generate and transmit the polling signal.

According to one embodiment, the means for generating and transmitting the polling signal may be adapted to establish a radio frequency link to the means for receiving the polling signal, wherein the radio frequency link carrying the polling signal preferably uses the same channel as the radio frequency link carrying the audio signal, with the polling signal being transmitted by the audio signal transmitter.

In an alternative embodiment, the means for generating and transmitting the polling signal may be adapted to establish an inductive link to the means for receiving the polling signal.

According to a further alternative embodiment, the means for receiving the polling signal and the means for generating and wirelessly transmitting the status information signal comprise a powerless electromagnetic signal response means adapted to be energized by energy included in the polling signal, with the status information signal being encoded in a modulation of the polling signal by the powerless electromagnetic signal response means. As a variant, the means for generating and wirelessly transmitting the status information signal may be a powerless electromagnetic signal response means adapted to be energized by energy included in an electromagnetic signal emitted by the means for receiving the status information signal, with the status information signal being encoded in a modulation of that electromagnetic signal by the powerless electromagnetic signal response means. Preferably, the powerless electromagnetic signal response means is an RFID (radio frequency identification) device.

The means for generating and transmitting the polling signal may comprise means for transmitting dedicated device addresses in order to specifically address the radio frequency receiver unit among a plurality of radio frequency receiver units.

Preferably, the means for generating and transmitting the polling signal comprise an FSK (frequency shift keying) modulator.

According to one embodiment, the means for generating and transmitting the status information signal and the means for receiving the status information signal and displaying status information are adapted to establish a radio frequency link carrying the status information signal, wherein the means for generating and transmitting the status information signal may comprise an FSK modulator. Preferably, the means for generating and transmitting the status information signal is adapted to use the same channel as radio frequency link carrying the audio signal, with the status information signal being transmitted via the antenna of the radio frequency receiver unit. The radio frequency transmitter and the radio frequency receiver unit in this case are preferably adapted to interrupt the radio frequency link carrying the audio signal while the status information signal is transmitted. This can be achieved by providing the radio frequency receiver unit with a RX/TX switch for the antenna.

Typically, the status information signal and/or the polling signal will be transmitted at a data rate of 100 bps to 2 kbps.

The means for generating and transmitting the polling signal and the means for receiving the polling signal at the audio signal receiver unit may be adapted to transmit remote control commands to the audio signal receiver unit, wherein the remote control commands may include commands for setting the frequency (channel) or frequency band of the wireless link carrying the audio signal and/or commands for setting the operation mode and operation parameters of the audio signal receiver unit, such as audio volume setting and gain setting.

These and further objects, features and advantages of the present invention will become apparent from the following description when taken in connection with the accompanying drawings which, for purposes of illustration only, show several embodiments in accordance with the present invention.

DETAILED DESCRIPTION OF THE INVENTION

Figure 1:
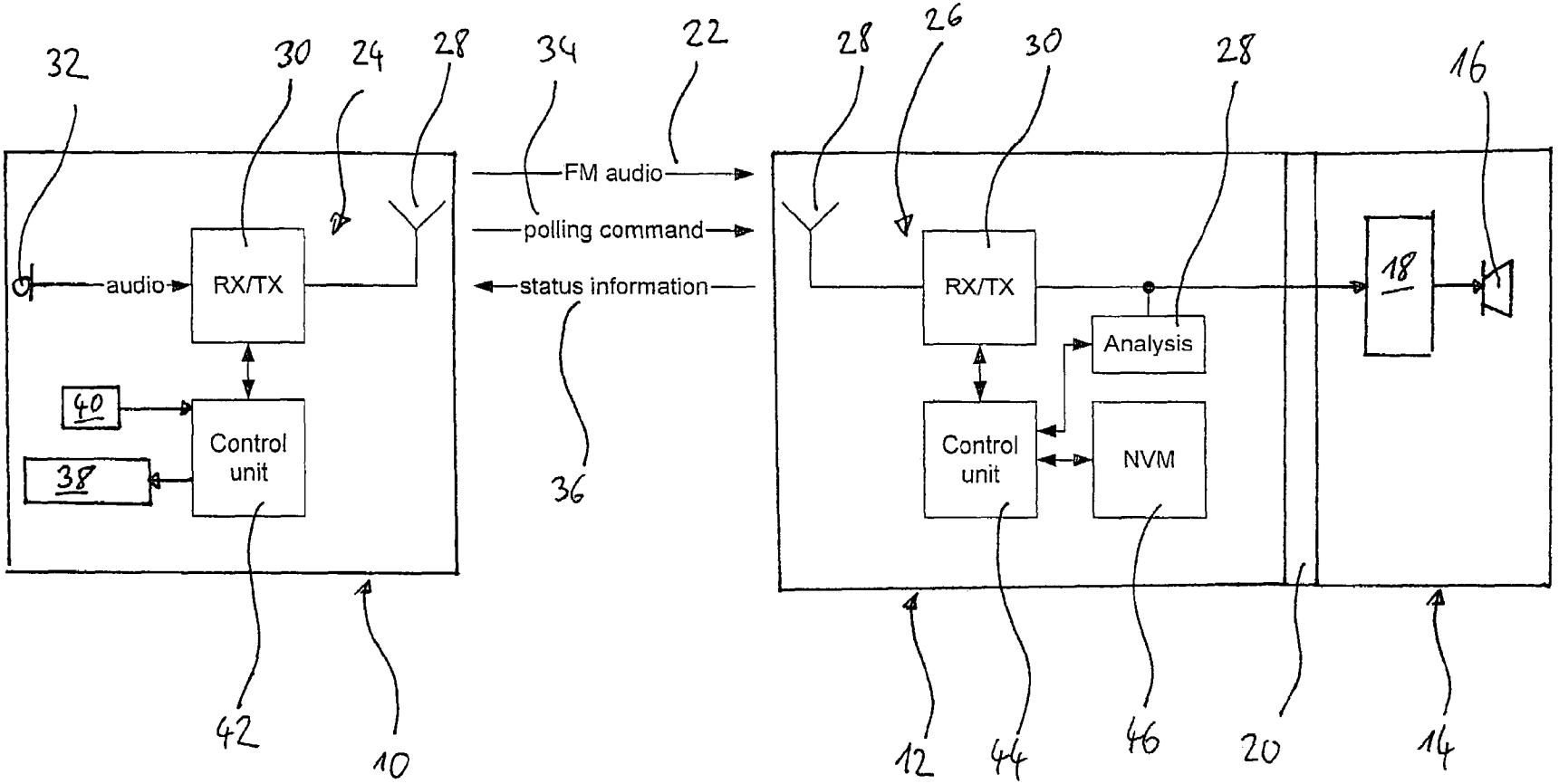
FIG. 1 is a schematic block diagram of a wireless hearing system according to a first embodiment of the invention.

The hearing system of FIG. 1 comprises a remote unit 10, an audio signal radio frequency receiver unit 12 and a hearing device 14. The hearing device 14 comprises an output transducer 16 for stimulation of a user's hearing, which typically will be an electro-acoustic transducer (speaker), with the hearing device 14 being designed such that the speaker 16 is located close to the outer end of the user's ear canal or within the ear canal when the hearing device 14 is worn by the user. Further, the hearing device 14 comprises an audio signal processing unit 18 for processing the input audio signals to the output transducer 16.

The hearing device 14 may be any type of headset or it may be a hearing aid/hearing instrument. In the latter case, the output transducer 16 could be a speaker, a cochlear implant (direct electrical stimulation of the inner ear) or an electromechanical transducer for direct mechanical stimulation of the middle ear or inner ear. The hearing aid may be arranged behind the ear, or partly or completely within the ear canal. In case that the hearing device 14 is not a hearing aid, it preferably may be a headset for a tourist tour guide or a museum guide system.

The radio frequency receiver unit 12 may provide the input audio signals to the hearing device 14 via a standardized interface 20. Alternatively, the radio frequency receiver unit 12 may be integrated within the hearing device 14. In any case, the radio frequency receiver unit 12 is adapted to establish a radio frequency link 22 for wireless transmission of audio signals from the remote unit 10. Usually, the radio frequency link 22 will be a frequency modulated (FM) link. To this end, the remote unit 10 comprises an RF transmitter/receiver 24 and the RF receiver unit 12 comprises a receiver/transmitter 26. The receiver/transmitters 24, 26 each comprise an antenna 28 and a transceiver 30.

The remote unit 10 comprises an audio signal source 32 which is usually a microphone. The remote unit 10 preferably is a hand-held device, which picks up the voice of a person using the remote unit 10, such as a teacher in a classroom for persons with hearing loss or the guide of a tourist tour or a museum tour, via the microphone 32, with this audio signal being transmitted via the RF link 22 to the RF receiver unit 12 and from there to output transducer 16 in order to provide the user of the hearing device 14 with the voice of the person using the remote unit 10. In a conventional system, the communication between the remote unit 10 and the RF receiver unit 12 would be unidirectional, namely from the remote unit 10 to the RF receiver unit 12, so that in a conventional system in the remote unit 10 only a RF transmitter function and in the RF receiver unit 12 only a RF receiver function would be necessary.

According to the present invention, such conventional system is modified such that the person using the remote unit 10 can easily monitor the RF audio link 22 by causing the RF receiver unit 12 to send status information regarding the status of the RF audio link 22 and/or the RF receiver unit 12 to the remote unit 10. This is achieved by providing the remote unit 10 with means for transmitting a polling signal/command 34 to the RF receiver unit 12 which is provided with means for receiving such polling signals 34. In addition, the RF receiver unit 12 is provided with means for generating and wirelessly transmitting, when the polling signal 34 has been received, a status information signal 36 containing data regarding the status of the RF link 22 and/or the RF receiver unit 12 to the remote unit 10 which is provided with means for receiving the status information signal 36 and displaying, via a display 38, status information derived from the status information signal 36. The remote unit 10 comprises a control unit 42 which controls the receiver/transmitter 24 and receives the status information signal from the transmitter/receiver 24 and an activation element 40 for causing the control unit 42 and the receiver/transmitter 24 to generate and wirelessly transmit the polling signal 34. The activation element 40 may be manually operable and/or it may be an activation timer in order to periodically generate and transmit the polling signal 34. The RF receiver unit 12 comprises a control unit 44 which controls the transmitter/receiver 26, a non-volatile memory 46 and an analysis unit 48 for analyzing the audio signal received by the transmitter/receiver 26. Both the analysis unit 48 and the memory 46 communicate with the control unit 44. The memory 46 contains the program for operating the RF receiver unit 12 and data needed for operation of the RF receiver unit 12.

The remote unit 10 and the RF receiver unit 12 preferably are designed such that the audio signal from the remote unit 10 can be transmitted through a plurality of different frequency bands/channels. With such a system, for example, in each classroom a specific frequency channel can be used in order to avoid reception of audio signals from an adjacent classroom. The selection of the respective frequency channel for each RF receiver unit 12 may be achieved, for example, by a synchronization unit mounted at the wall of each classroom. For such a multichannel system the status information signal 36 would include information regarding the channel on which the respective RF receiver unit 12 is set. Thereby the teacher immediately could recognize from the display 38 whether the respective pupil wearing the respective RF receiver unit 12, for example, is using a wrong frequency channel so that he could not receive the audio signal transmitted by the remote unit 10. In addition, the status information signal 36 may contain information regarding the signal to noise ratio of the RF audio link 22 as detected by the analysis unit 48. Further, the status information signal may include information regarding the integrity of the electrical connections between the RF receiver unit 12 and the hearing device 14 via the interface 20.

In the embodiment of FIG. 1 the RF link carrying the polling signal 34 uses the same channel as the RF audio link 22 and also the status information signal 36 uses the same channel as the RF audio link 22. Thereby the transmitter function of the transmitter/receiver 24 of the remote unit 10 may be used not only for the RF audio link 22 but also for the link for the polling signal 34. This applies analogously also to the receiver function of the receiver/transmitter 26 of the RF receiver unit 12. Transmission and reception of the status information signal 36 may occur via the antennas 28 of the remote unit 10 and the RF receiver unit 12, respectively, which are already used for the RF audio link 22. Such multiple use of the RF audio link channel can be achieved by interrupting the RF audio link 22 while the status information signal 22 or the polling signal 34 is transmitted.

The status information signal 36 and the polling signal 34 typically are transmitted at a low data rate of 100 bps to 2 kbps.

Figure 2:
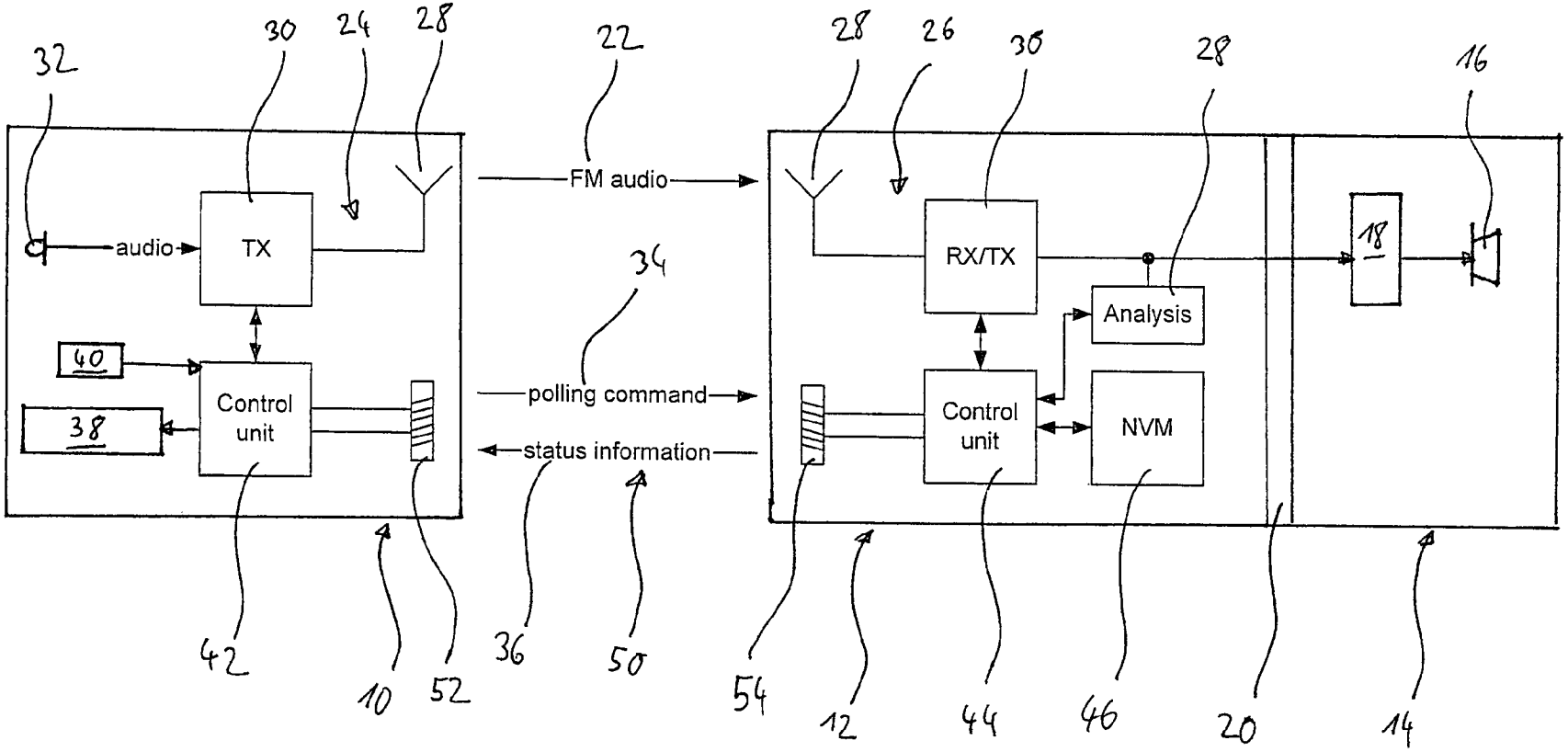
FIG. 2 is a view like FIG. 1 of a second embodiment of the invention.

FIG. 2 shows an example of an alternative embodiment wherein the polling signal 34 and the status information signal 36 are not transmitted via the same channel as the RF audio signal but rather a separate wireless channel 50 is provided for transmission of the polling signal 34 and the status information signal 36. In the case of the embodiment shown in FIG. 2, this separate channel 50 is an inductive link comprising an inductive antenna 52 provided at the remote unit 10 and connected with the control unit 42 and an inductive antenna 54 provided at the RF receiver unit 12 and connected with the control unit 44. The antennas 52 and 54 are adapted both for transmitting and receiving, with the antenna 52 transmitting the polling signal 34 and receiving the status information signal 36 and with the antenna 54 transmitting the status information signal 36 and receiving the polling signal 34.

Figure 3:
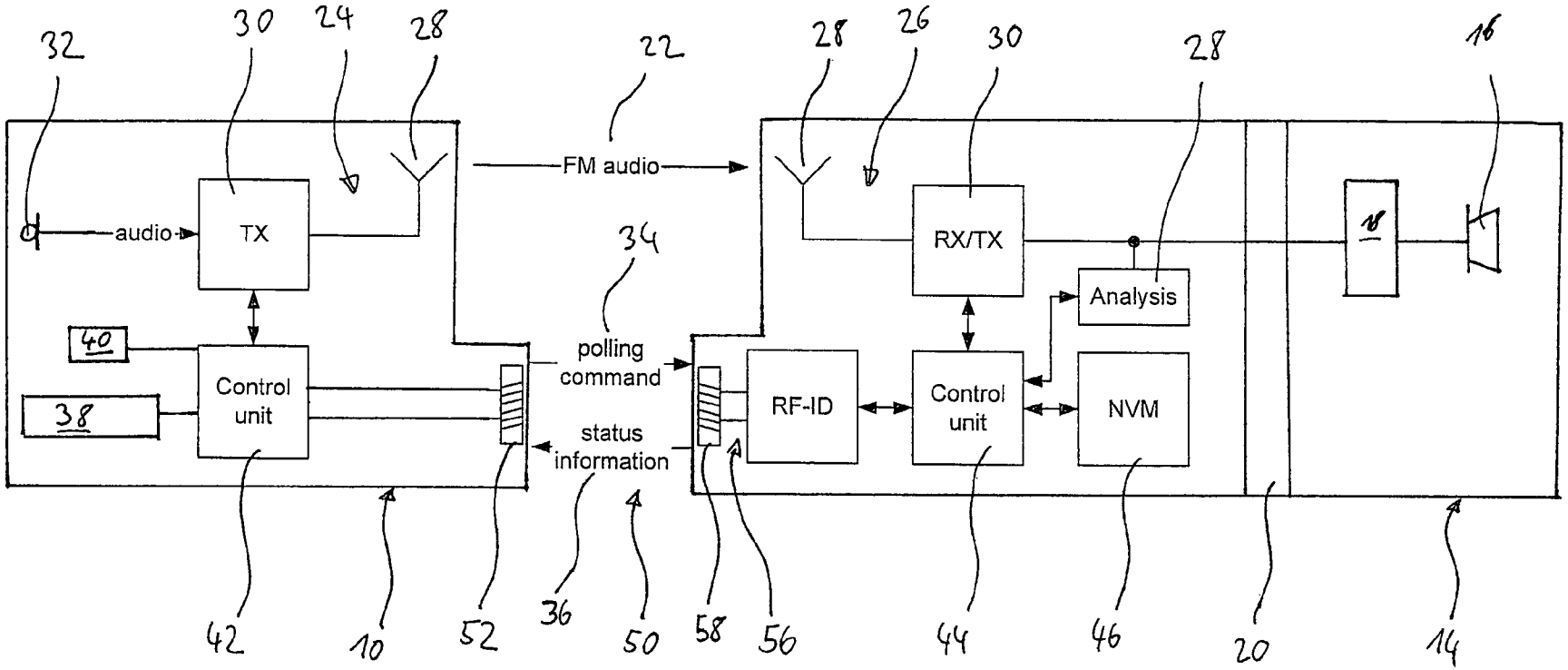
FIG. 3 is a view like FIG. 1 of a third embodiment of the invention.

The inductive link 50 may be, for example, a 40 kHz FSK modulated inductive channel such as it is conventionally used for remote control purposes and programming of RF receiver units for hearing aids. Preferably, the inductive link 50, in addition to transmitting the polling signal 34 and the status information signal 36, may be used for transmitting remote control commands to the RF receiver unit 12, such as commands for setting the frequency or frequency band of the audio RF link 22 and/or commands for setting the operation mode and operation parameters of the RF receiver unit 12, such as audio volume setting and gain setting. In the embodiments of FIGS. 2 and 3 the receiver/transmitter 24 of FIG. 1 is replaced by an audio signal transmitter 25 comprising an antenna 28 and a transmitter element 31 replacing the transceiver 30.

FIG. 3 shows an embodiment wherein the separate link 50 for the polling signal 34 and the status information signal 36 is realized as a powerless system by using a powerless electromagnetic signal response device 56 at the RF receiver unit 12. Such powerless response devices are known as radio frequency identification (RFID) systems and are commonly used, for example, in door access systems or theft surveillance systems. A description of RFID systems may be found, for example, in the "RFID-Handbook", $2^{nd}$ edition, by Klaus Finkenzeller, Wiley and Sons Ltd., April 2003. In the embodiment of FIG. 3 the response device 56 is adapted to be energized by energy included in the polling signal 34, with the status information signal 36 being encoded in a modulation of the polling signal 34 caused by the response device 56. The range of RFID systems may be increased by powering the signal response device 56.

The response device 56 may include an antenna 58, an analogue circuit for receiving and transmitting RF signals, a digital circuit and a data memory wherein the status information basic to a status information signal 36 is stored by action of the control unit 44.

Generally, in all embodiments in which the remote unit 10 is used for providing audio signals to a plurality of RF receiver units 12 simultaneously, these RF receiver units 12 have to be addressed individually for gaining the desired status information signal 36 from a selected RF receiver unit 12. This can be achieved, for example, by transmitting dedicated device addresses from the remote unit 10 in order to specifically address a selected one of the RF receiver units 12. Such dedicated device addresses may be included in the polling signal 34. Such addresses may advantageously be programmable in both units 10 and 12. Another option is to achieve selection of the RF receiver unit 12 by controlling the range of the polling signal 34. This option is particularly appropriate if the polling signal 34 is transmitted via an inductive link, since the decay of inductive signals with the distance from the transmitter is extremely steep. In this case, selection of the RF receiver unit 12 is practically achieved by approaching the selected RF receiver unit 12 with the remote unit 10 (for example, the teacher using a remote unit 10 approaches the pupil using the selected RF receiver unit 12).

In order to enable a distinction between the FM receiver unit 12 used for the right ear and that used for the left ear the status information signal 36 may include information on whether the RF receiver unit 12 is for a right ear or for a left ear. Such information can be provided, for example, by delaying the status information signal 36 depending on whether the RF receiver unit 12 is for a right ear or for a left ear.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as encompassed by the scope of the appended claims.

What is claimed is:

1. A hearing system comprising a hearing device having an output transducer for stimulation of a user's hearing, an audio signal transmitter, an audio signal source for providing audio signals to the audio signal transmitter, an audio signal receiver unit adapted to establish a wireless link for transmission of said audio signals from said audio signal transmitter to said audio signal receiver unit, said audio signal receiver unit being connected to or integrated within said hearing device for providing said audio signals received from said audio signal transmitter as input to said hearing device, means for generating and wirelessly transmitting a polling signal to said audio signal receiver unit, means for receiving said polling signal at said audio signal receiver unit, means for generating and wirelessly transmitting, when said polling signal has been received, a status information signal containing data regarding a status of at least one of said wireless audio signal link and said receiver unit, and means for receiving said status information signal and displaying status information derived from said status information signal to a person other than said user of the hearing device, wherein the means for generating and transmitting the polling signal comprise an activation element which is manually operable by said person other than said user.

2. The system of claim 1, wherein at least two elements selected from the group consisting of said audio signal source, said audio signal transmitter, said means for generating and transmitting said polling signal and said means for receiving said status information signal and displaying said status information are integrated in a common device to be used by said person other than said user.

3. The system of claim 2, wherein said common device is a handheld device.

4. The system of claim 1, wherein said means for receiving said status information signal and displaying said status information is adapted to display said status information graphically.

5. The system of claim 1, wherein said means for receiving said status information signal and displaying said status information is adapted to display said status information together with data identifying said audio signal receiver unit among a plurality of audio signal receiver units.

6. The system of claim 1, wherein said means for generating and transmitting said polling signal comprises at least one of an activation element which is manually operable and an activation timer.

7. The system of claim 1, wherein the means for generating and transmitting said polling signal is adapted to establish a radio frequency link to said means for receiving said polling signal.

8. The system of claim 7, wherein said audio signal transmitter and said audio signal receiver unit are adapted to establish a radio frequency link for said audio signal.

9. The system of claim 8, wherein said radio frequency link carrying the polling signal uses the same channel as said radio frequency link carrying said audio signal, with said polling signal being transmitted by said radio frequency transmitter.

10. The system of claim 1, wherein said means for generating and transmitting said polling signal is adapted to establish an inductive link to said means for receiving said polling signal.

11. The system of claim 1, wherein said means for generating and transmitting said polling signal comprises means for transmitting dedicated device addresses in order to specifically address said audio signal receiver unit among a plurality of audio signal receiver units.

12. The system of claim 1, wherein said means for generating and transmitting said polling signal comprises a frequency shift keying modulator.

13. The system of claim 8, wherein said means for generating and transmitting said status information signal and said means for receiving said status information signal and displaying said status information are adapted to establish a radio frequency link carrying said status information signal.

14. The system of claim 13, wherein said means for generating and transmitting said status information signal comprises a frequency shift keying modulator.

15. The system of claim 13, wherein said means for generating and transmitting said status information signal is adapted to use the same channel as said radio frequency link carrying said audio signal, with said status information signal being transmitted via an antenna of said audio signal receiver unit.

16. The system of claim 15, wherein said audio signal transmitter and said audio signal receiver unit are adapted to interrupt said radio frequency link carrying said audio signal while said status information signal is transmitted.

17. The system of claim 1, wherein said means for generating and transmitting said status information signal and said means for receiving said status information signal and displaying said status information are adapted to establish an inductive link carrying said status information signal.

18. The system of claim 1, wherein said means for receiving said polling signal and said means for generating and wirelessly transmitting said status information signal comprise a powerless electromagnetic signal response means adapted to be energized by energy included in said polling signal, with said status information signal being encoded in a modulation of said polling signal caused by the powerless electromagnetic signal response means.

19. The system of claim 1, wherein at least one of said status information signal and said polling signal is transmitted at a data rate of 100 bps to 2 kbps.

20. The system of claim 1, wherein said means for generating and transmitting said polling signal and said means for receiving said polling signal at said audio signal receiver unit are adapted to transmit remote control commands to said audio signal receiver unit.

21. The system of claim 20, wherein said remote control commands include at least one of commands for setting a frequency or frequency band of said wireless link carrying said audio signal and commands for setting an operation mode and operation parameters of said audio signal receiver unit.

22. The system of claim 1, wherein said hearing device is a hearing aid.

23. The system of claim 22, wherein said status information signal includes information regarding at least one of an integrity of electrical connections between said audio signal receiver unit and said hearing aid, a present frequency or frequency band of said wireless link carrying said audio signal, confirmation of remote control commands for setting an operation mode or operation parameters of said audio signal receiver unit, a present operation mode of said audio signal receiver unit, a present setting of operation parameters of said audio signal receiver unit, a signal to noise ratio of said wireless link carrying said audio signal, a battery status of said audio signal receiver unit or said hearing aid, identification of said audio signal receiver unit among a plurality of audio signal receiver units, a date of last servicing of said audio signal receiver unit, and a user's name.

24. The system of claim 22, wherein said status information signal includes information regarding at least one of a present operation mode of said hearing aid and a present setting of operation parameters of said hearing aid.

25. The system of claim 1, wherein said status information signal includes data on whether said audio signal receiver unit is for a right ear or a left ear.

26. The system of claim 25, wherein transmission of said status information signal is time-delayed depending on whether said audio signal receiver unit is for a right ear or a left ear.

27. The system of claim 1, wherein said wireless link carrying said audio signal is a frequency modulation link.

28. The system of claim 1, wherein said audio signal source is a remote microphone.

29. A system for providing audio signals to a hearing device having an output transducer for stimulation of a user's hearing, comprising: an audio signal transmitter, an audio signal source for providing audio signals to said audio signal transmitter, an audio signal receiver unit adapted to establish a wireless link for transmission of said audio signals from said audio signal transmitter to said audio signal receiver unit, said audio signal receiver unit being adapted to be connected to said hearing device for providing said audio signals received from said audio signal transmitter as input to said hearing device, means for generating and wirelessly transmitting a polling signal to said audio signal receiver unit, means for receiving said polling signal at said audio signal receiver unit, means for generating and wirelessly transmitting, when said polling signal has been received, a status information signal containing data regarding a status of at least one of said wireless audio signal link and said audio signal receiver unit, and means for receiving said status information signal and displaying status information derived from said status information signal to a person other than said user of the hearing device, wherein the means for generating and transmitting the polling signal comprise an activation element which is manually operable by said person other than said user.

30. A method for monitoring a hearing system comprising a hearing device having an output transducer for stimulation of a user's hearing, an audio signal transmitter, an audio signal source, and an audio signal receiver unit connected to or integrated within said hearing device, comprising:

providing audio signals from said audio source to said audio signal transmitter;

establishing a wireless link for transmission of said audio signals from said audio signal transmitter to said audio signal receiver unit;

providing said audio signals received by said audio signal receiver unit from said audio signal transmitter as input to said hearing device;

generating and wirelessly transmitting a polling signal to said audio signal receiver unit;

receiving said polling signal at said audio signal receiver unit;

generating and wirelessly transmitting, upon reception of said polling signal, a status information signal containing data regarding a status of at least one of said wireless audio signal link and said audio signal receiver unit;

receiving said status information signal; and displaying status information derived from said status information signal to a person other than said user of the hearing device, wherein the polling signal is generated by using an activation element which is manually operated by said person other than said user.

* * * * *